US009875833B2

(12) United States Patent
Frank et al.

(10) Patent No.: US 9,875,833 B2
(45) Date of Patent: Jan. 23, 2018

(54) SUPERCONDUTING COIL DEVICE COMPRISING COIL WINDING AND CONTACTS

(71) Applicant: SIEMENS AKTIENGESELLSCHAFT, München (DE)

(72) Inventors: Michael Frank, Uttenreuth (DE); Jörn Grundmann, Grossenseebach (DE); Wolfgang Nick, Nürnberg (DE); Marijn Pieter Oomen, Erlangen (DE); Peter Van Hasselt, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 14/652,710

(22) PCT Filed: Dec. 2, 2013

(86) PCT No.: PCT/EP2013/075241

§ 371 (c)(1),
(2) Date: Jun. 16, 2015

(87) PCT Pub. No.: WO2014/095328

PCT Pub. Date: Jun. 26, 2014

(65) Prior Publication Data

US 2015/0318099 A1 Nov. 5, 2015

(30) Foreign Application Priority Data

Dec. 17, 2012 (DE) ..... 10 2012 223 366

(51) Int. Cl.
*H01B 12/00* (2006.01)
*H01F 6/06* (2006.01)

(52) U.S. Cl.
CPC ..... *H01F 6/06* (2013.01); *H01F 6/065* (2013.01)

(58) Field of Classification Search
CPC ..... H01F 6/06; H01F 6/065
(Continued)

(56) References Cited

U.S. PATENT DOCUMENTS 5,312,802 A 5/1994 Hayashi et al.
2009/0293504 A1 12/2009 Oomen et al.

FOREIGN PATENT DOCUMENTS

CN 1455934 A 11/2003
CN 1596479 A 3/2005
(Continued)

OTHER PUBLICATIONS

Machine Translation of JP 2003-323822 (2003).*
(Continued)

*Primary Examiner* — Paul Wartalowicz
(74) *Attorney, Agent, or Firm* — Henry M. Feiereisen LLC

(57) ABSTRACT

A superconducting coil device includes at least one coil winding, including at least one first and one second superconducting strip conductor, the first and second strip conductors each having a superconducting layer and a contact side provided with a contact layer; at least one first contact electrically connecting the contact side of the first strip conductor to an external circuit via a first contact piece; at least one second contact electrically connecting the contact side of the second strip conductor to the external circuit via a second contact piece; and a third contact electrically connecting the first and second strip conductors via the contact layer of the first and the second strip conductor within the coil winding, wherein the contact side of the first strip conductor has a different orientation relative to a center
(Continued)

Figure 1:
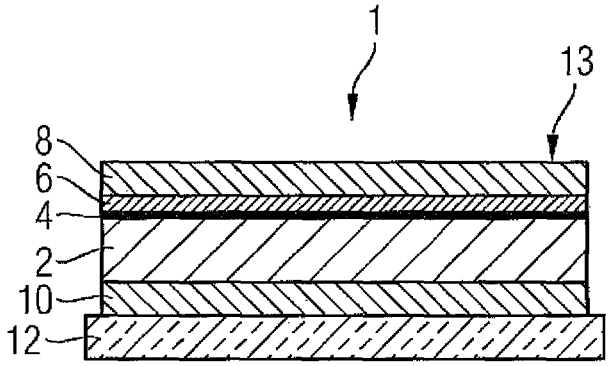

of the coil winding than the contact side of second strip conductor.

16 Claims, 4 Drawing Sheets

(58) Field of Classification Search
USPC ..... 505/211; 335/216
See application file for complete search history.

(56) References Cited

FOREIGN PATENT DOCUMENTS

| | | | |
|---|---|---|---|
| CN | 101036243 | A | 9/2007 |
| CN | 101385096 | A | 3/2009 |
| CN | 101548345 | A | 9/2009 |
| CN | 101765892 | A | 6/2010 |
| CN | 101923936 | A | 12/2010 |
| DE | 102008029722 | B3 | 12/2009 |
| JP | 2004040036 | A | 2/2004 |
| JP | 2008140905 | A | 6/2008 |
| JP | 2008140930 | A | 6/2008 |

OTHER PUBLICATIONS

Frank et al., U.S. Pat. No. 7,339,293, Mar. 4, 2008, 2006-0125331, Jun. 15, 2006.
Frank et al., U.S. Pat. No. 7,528,510, May 5, 2009, 2007-0095075, May 3, 2007.
Frank et a., U.S. Pat. No. 7,795,764, Sep. 14, 2010, 2009-0267425, Oct. 29, 2009.
Frank et al., U.S. Pat. No. 8,063,520, Nov. 22, 2011, 2010-0176667, Jul. 15, 2010.
Teng Xinkang: "Research for producing of the HTS magnets"; pp. 298-299; New functional materials 1: optical electrical material and intelligent materials; Dec. 31, 1997.

* cited by examiner

SUPERCONDUTING COIL DEVICE COMPRISING COIL WINDING AND CONTACTS

CROSS-REFERENCES TO RELATED APPLICATIONS

This application is the U.S. National Stage of International Application No. PCT/EP2013/075241 filed Dec. 2, 2013, which designated the United States and has been published as International Publication No. WO 2014/095328 A1 and which claims the priority of German Patent Application, Serial No. 10 2012 223 366.0, filed Dec. 17, 2012, pursuant to 35 U.S.C. 119(a)-(d).

BACKGROUND OF THE INVENTION

The present invention relates to a superconducting coil device with a coil winding comprising at least two superconducting strip conductors and contacts for connecting the coil device to an external circuit.

Coil devices are known in the field of superconducting machines and superconducting magnetic coils in which superconducting wires or strip conductors are wound into coil windings. Conductors in the form of wires are usually used for classical low-temperature superconductors such as NbTi and $Nb_3Sn$. High-temperature superconductors or also high-Tc superconductors (HTS) on the other hand are superconducting materials with a critical temperature of above 25 K and for a few classes of material of above 77 K. These HTS conductors are typically available in the form of flat strip conductors, having a strip-type substrate strip and a superconducting layer disposed on the substrate strip. In addition the strip conductors often have even further layers such as stabilization layers, contact layers, buffer layers and in some cases also insulation layers. The most important class of material of the so-called second-generation HIS conductors (2G-HTS) are compounds of the type $REBa_2Cu_3O_x$, wherein RE stands for an element of the rare earths or a mixture of such elements.

The substrate strip typically consists of either steel or the alloy Hastelloy. Electrical contact to an external circuit is mostly established via a contact layer made of copper, wherein this contact layer is either applied on one side above the super conducting layer or can surround the entire strip conductor as an enveloping layer. In both versions it is better to establish the contact on the upper side, i.e. on the side of the substrate strip which bears the superconducting strip. With contacting on the rear side, i.e. on the side of the substrate facing away from the superconducting layer, higher contact resistances occur, which leads to greater electrical losses and an increased need for cooling in these areas.

With a superconducting coil winding, in which a number of layers of a strip conductor lie in a number of turns above one another, it is often difficult to contact both ends of the coil winding on the upper side. With standard winding techniques used for manufacturing disk windings the upper side of the strip conductor will usually be facing inwards either on the inner side or on the outer side of the winding. In order, despite this, to create a low-resistance contact on the upper side of the strip conductor, with known coil devices a specially designed contact piece is used, which is pushed into the winding on the upper side of the strip conductor. However a complex manufacturing process is needed for such a coil device since, to guarantee the mechanical stability needed, particular measures must be taken at the location of this contact piece. If a wet winding process with an epoxy adhesive is used then first of all a filler piece, made of Teflon for example, must be inserted in order to keep the points to be contacted free from adhesive. After removal of the filler piece, for contacting this point for example, a solder connection to a contact piece made, of copper can be established. However since this contact lies within the winding, to establish the necessary mechanical stability of the contact area, it must be fixed retroactively with bandages made of glass fiber reinforced plastic and epoxy adhesive.

SUMMARY OF THE INVENTION

The object of the present invention is to specify a superconducting coil device which avoids the said disadvantages.

This object is achieved by the coil device described in the independent claim. The inventive coil device comprises a least one coil winding with a first and a second strip conductor, wherein each of the two strip conductors has a contact side with a contact layer. Furthermore the coil device comprises at least a first contact between the first strip conductor and a first contact piece and a second contact between the second strip conductor and a second contact piece for connecting the coil device to an external circuit. Within the coil winding the first strip conductor and the second strip conductor are connected electrically via a third contact between their contact layers.

The first and the second strip conductor differ in relation to the orientation of the contact side to a center of the coil winding. In such cases contact side refers to the upper side mentioned at the start.

The effect of creating an additional third contact within the winding is that the strip conductor is turned around within the winding. This leads, for a simple winding consisting of a plurality of flat turns lying above one another, both on the inner side of the winding and also on the outer side of the winding, to the side of the strip conductor with the lower resistance contact to the superconducting layer lying on the outside. The inner side of the winding here refers to the central area of the spiral which forms the coil winding. The creation of the third contact between the contact layer of the first strip conductor and contact layer of the second strip conductor makes it possible to establish an especially low-resistance connection between the superconducting layer of the first strip conductor and the superconducting layer of the second strip conductor via the respective associated contact layers.

Usually the creation of additional contacts within superconducting windings is avoided, since with such an additional contact point an ohmic resistance is always introduced into the winding. The structure of the inventive coil device is based on the knowledge that such an additional ohmic contact within the winding can still be advantageous if the establishing of the outer contacts is simplified thereby. The series resistance present overall can in some cases even be lower than with a conventional coil winding, since the contacts to the external circuit can be made over a larger surface and can be designed to have lower resistance if no contact pieces need to be inserted into the inside of the winding at the ends. The mechanical stability of the inventive coil is also higher, since the additional contact inside the winding can either be glued in as well during the manufacturing of the coil in a wet winding process or can be enclosed in a subsequent casting of the coil in casting compound. The gluing-in or casting-in of the additional contact point can be done in the same method step as the gluing-in or casting of the remaining windings so that, to achieve the same mechanical stability, fewer method steps are needed than with known coil devices with a contact piece at the outer end of the winding.

Advantageous embodiments and developments of the inventive coil device emerge from the dependent claims. Accordingly the coil device can additionally have the following features:

The first contact can be disposed on a side of the first strip conductor facing away from one of the turns of the first strip conductor and the second contact can be disposed on a side of the second strip conductor facing away from one of the turns of the second strip conductor.

The first contact can be formed between the first contact piece and the contact layer on the contact side of the first strip conductor and the second contact can be formed between the second contact piece and the contact layer on the contact side of the second strip conductor.

The first contact can be disposed on the inner side of the coil winding and the second contact can be disposed on the outer side of the coil winding. With this embodiment, on both sides of the winding arrangement, i.e. inside and outside easy access to the two contact points to the external circuit is possible. As above the inner side of the winding arrangement refers to the central area of the spirals.

The third contact between the first strip conductor and the second strip conductor can be embodied by a soldered connection. Advantageous solder materials for making a low-resistance contact are indium-based solders.

The contact resistance of the third contact can advantageously be less than 1 μOhm, especially advantageously less than 100 nOhm.

The third contact between the first and second strip conductor can advantageously be embodied over a length of between 1 cm and 5 cm.

The coil device can include a cooling device for cooling the windings. Such cooling is expedient to guarantee an operating temperature of the superconductor below its critical temperature. In the area of the third contact the thermal connection to the cooling device can be more strongly marked than in the other inner areas of the winding. Since there is an ohmic resistance in the area of the third contact it will cause heat to develop at this point. In order to also keep the superconducting strip conductor at its operating temperature in this area, it is advantageous to create a stronger thermal connection to the cooling device at these points than in the other inner areas of the winding. A stronger thermal connection than in the inner area of the winding is also expedient in the areas of the first and second contact at the respective ends of the winding.

The coil device can have a superconducting layer. The superconducting layer can contain a second-generation high-temperature superconductor, especially $ReBa_2Cu_3O_x$. The letters RE here stand for an element of the rare earths or a mixture of such elements.

The contact layer can contain copper. Likewise the first and the second contact piece can contain copper.

The first and the second strip conductor can each include a substrate which especially contains steel and/or the alloy Hastelloy.

The first and the second strip conductor can also include a contact layer on the side of the substrate facing away from the superconducting layer and/or be enveloped on all sides by a contact layer. Even if a contact layer is present on the side of the substrate facing away from the superconducting layer it is advantageous to contact the contact strip on the side of the superconducting layer, since the ohmic resistance is lower here than if the contact has to be realized through the substrate strip or around the edge of the strip.

The coil winding can be embodied as a disk winding, especially as a race-track coil a rectangular coil or as a circular disk winding.

The turns of the coil device can be mechanically fixed with a casting compound and/or with an adhesive. This is especially advantageous for applications in motors and generators in which high centrifugal forces occur and for applications in magnetic coils in which high Lorentz forces occur. In both cases the casting compound and/or the gluing protects the coil winding against mechanical stresses.

Protection against such mechanical stresses is expedient above all in the use of high-temperature superconductors with sensitive ceramic materials. Advantageous materials for casting-in or gluing-in the coil winding are epoxy materials.

The coil winding can comprise an even number of strip conductors, which are connected with one another via an odd number of contacts. If more than two strip conductors are connected to one another via more than one contact, if an odd number of contacts are present a turning around of the strip conductor on the length of the coil winding can still be effected, which in turn makes possible simplified contacting at the ends of the coil winding.

The coil device can also comprise a stack of a number of layers above one another, wherein each layer of the stack comprises at least two strip conductors connected to one another via at least one contact. Advantageously, within each layer of the stack, the number of the strip conductors connected to one another is even and the number of contact points is odd.

Figure 2:
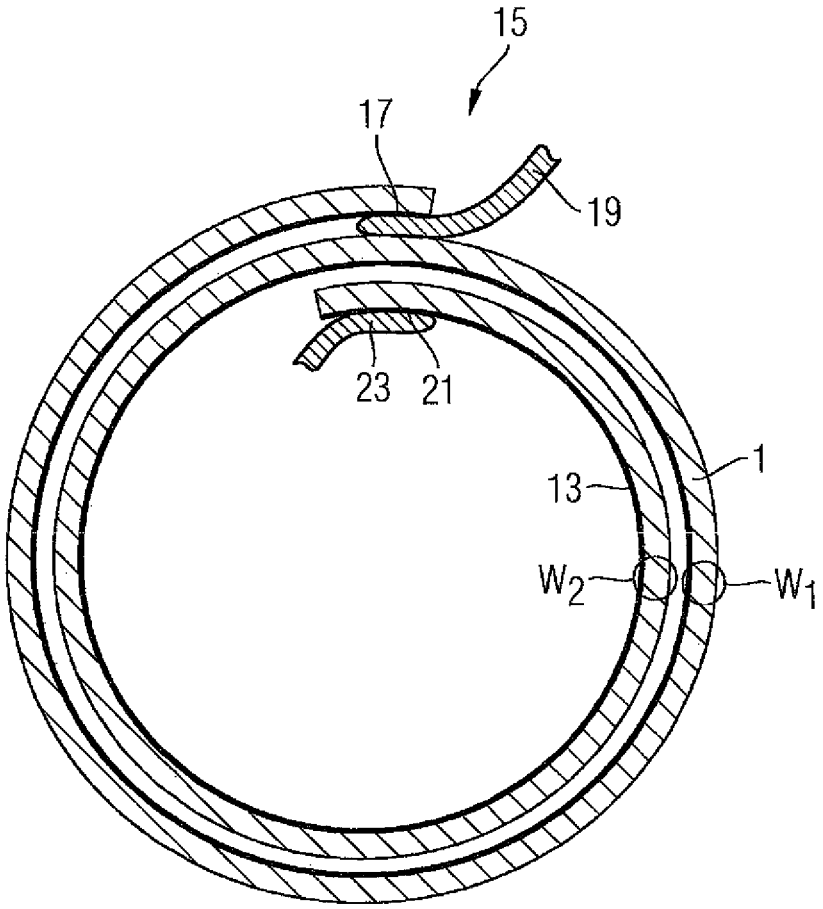
FIG 2 Prior Art
Figure 3:
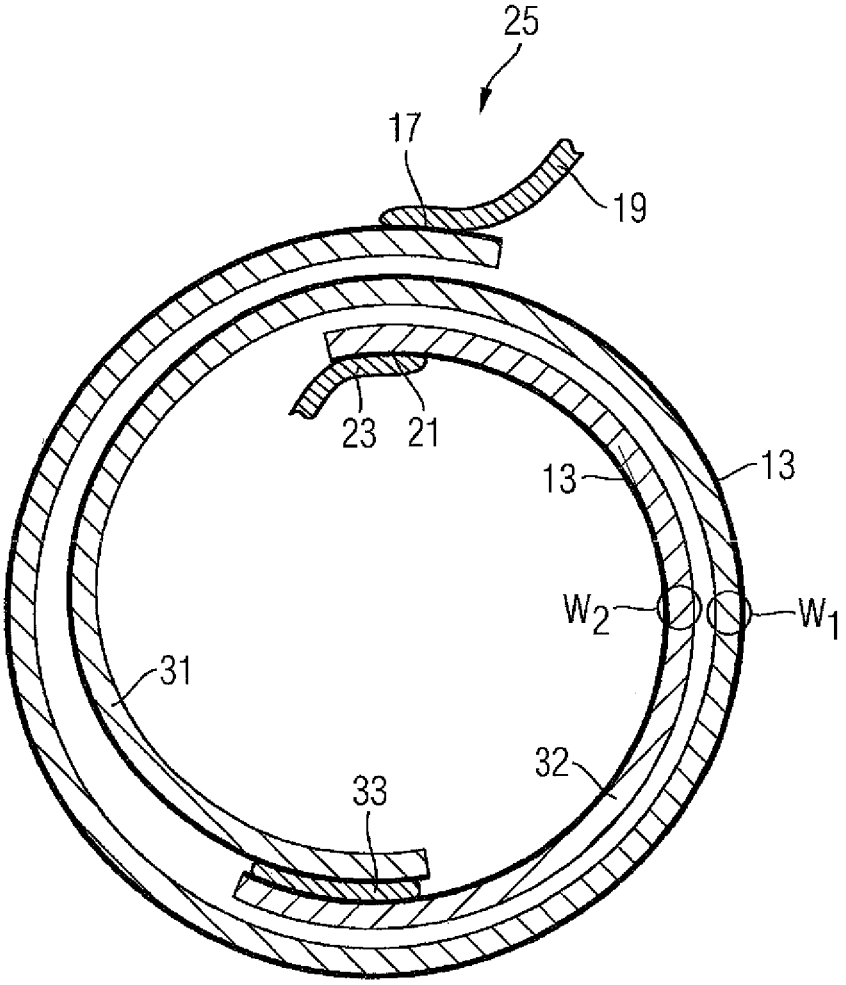
Figure 4:
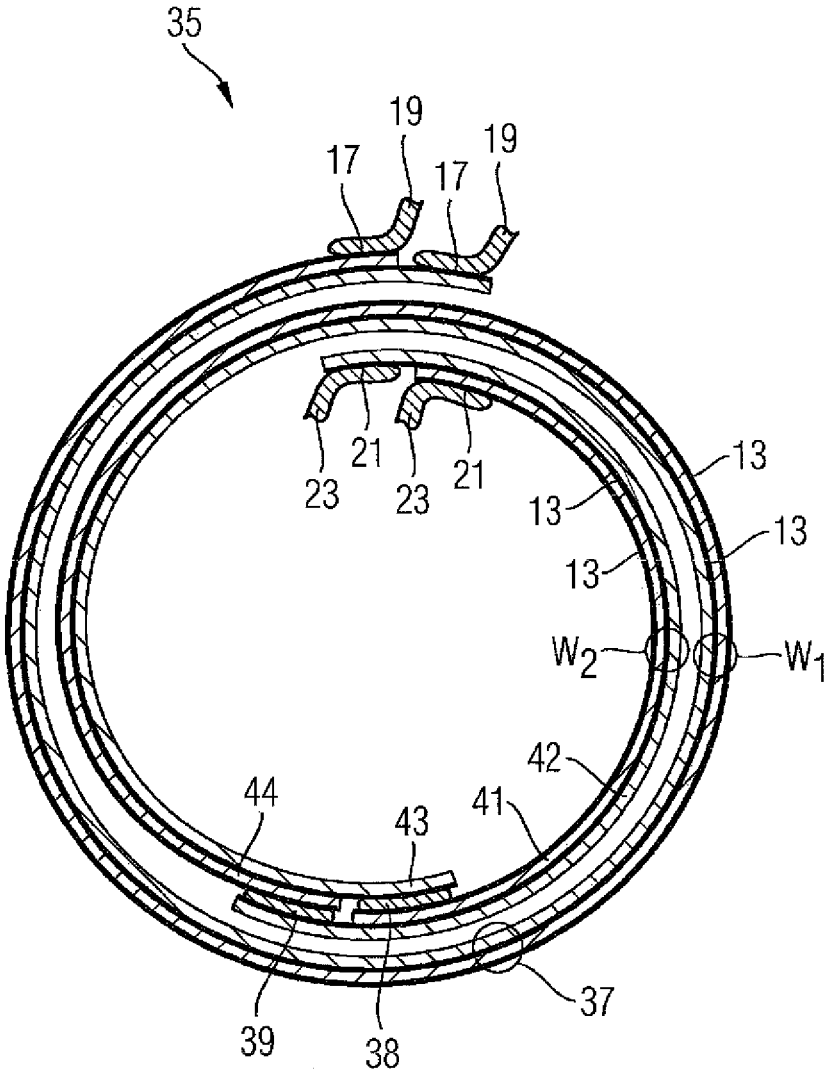

The invention is described below on the basis of two preferred exemplary embodiments, which refer to the appended drawings, in which:

FIG. 1 shows a schematic cross-section of a superconducting strip conductor, FIG. 2 shows a schematic view of a coil winding according to the prior art, FIG. 3 shows a schematic view of a coil winding according to a first exemplary embodiment, and FIG. 4 shows a schematic view of a coil winding according to a second exemplary embodiment.

FIG. 1 shows a cross-section of a superconducting strip conductor 1 in which the layer structure is presented schematically. The strip conductor in this example comprises a substrate strip 2, which is a 100 μm thick substrate strip made of a nickel-tungsten alloy. As an alternative steel strips or strips made of an alloy such as Hastelloy for example can be used. Disposed above the substrate strip is a 0.5 μm thick buffer layer 4 which here contains the oxidic materials $CeO_2$ and $Y_2O_3$. Above this is the actual superconducting layer 6, here a 1 μm thick strip of $YBa_2Cu_3O_x$, which in its turn is covered by a 50 μm thick contact layer 8 made of copper. As an alternative to the material $YBa_2Cu_3O_x$ the corresponding compounds $REBa_2Cu_3O_x$ of other rare earths RE can be used. On the opposite side of the substrate strip here a further 50 μm thick cover layer 10 made of copper is disposed, followed by an insulator 12, which is embodied in this example as a 25 μm thick Kapton strip. The insulator 12 can however also be constructed from other insulating materials such as other plastics for example. In the example shown the width of the insulator 12 is somewhat larger than the width of the other layers of the strip conductor 1, so that with a winding of the coil device, turns which lie above one another are reliably insulated from one another. As an alternative to the example shown it is possible to not wind an insulator strip into the coil device as a separate strip until the coil winding is being manufactured. This is especially advantageous if a number of strip conductors are wound in parallel which do not have to be insulated from one another. Then for example a stack of 2 to 10 strip conductors lying one above the other without an insulation layer can be wound together with an additionally inserted insulation strip into common turns.

Contacting of the strip conductor 1 is advantageously possible via the contact layer 8. The side of the strip conductor 1 lying at the top in FIG. 1 is therefore also referred to as the contact side 13.

FIG. 2 represents a highly schematic view of a coil winding 15 according to the prior art. Here a strip conductor 1 is wound in two turns $W_1$ and $W_2$ to the coil winding 15. The number of turns is only to be understood as an example here. In typical applications the number of turns is usually between 10 and 500. In the coil winding shown the strip conductor 1 is wound so that the contact side 13 lies on the inside. In order to connect the coil winding 15 to an external circuit, two contacts 17, 21 with two contact pieces 19 and 23 are needed. The first contact 17 in such cases lies on the outside of the coil and the second contact 21 lies on the inside of the coil. Since the contact side 13 of the strip conductor 1 lies on the inside with the second contact, simple contacting in a free area of the strip conductor is possible. On the outside on the other hand the first contact 17 is made by the first contact piece 19 being pushed into the coil winding. With gluing of the coil during the winding process this area must be kept free from adhesive. After the first contact 17 is established, to guarantee the mechanical stability of the coil, there must be a retroactive gluing and/or reinforcement (not shown here). The contact pieces 19, 23 are typically massive blocks of copper having a large cross-section in order to make available the very high operating currents for the superconducting coil device. This means that the first contact piece 19 inserted into the winding requires a large amount of space which is mostly significantly greater than that shown in the schematic view of FIG. 1.

FIG. 3 shows a highly schematic view of a coil winding 25 according to a first exemplary embodiment of the invention. Here too only two turns $W_1$ and $W_2$ are shown once again, which are intended to stand for a significantly larger number of turns, for example between 10 and 500 turns. The coil winding 25 is once again able to be connected via two contacts 17, 21 and contact pieces 19, 23 to an external circuit. The coil winding 25 contains a first strip conductor 31 and a second strip conductor 32, which are connected to one another via a third contact 33. The third contact 33 is realized in this example via a soldered connection between the contact sides 13 of the two strip conductors, with indium-based solder as the solder material. The connection is thus made between the contact layers 8 of the strip conductors. The contact resistance of the third contact is less than 100 nOhm. The third contact is embodied over a length of 3 cm. The connection of the first and second strip conductors leads to the contact side 13 being freely accessible both on the inside and also on the outside of the coil winding. This enables the contacts 17 and 21 for connection to an external circuit to be made in a simple manner. Both contacts 17 and 21 can be made for example by establishing soldered connections to the contact pieces 19 and 23 without a contact piece having to be introduced into the winding. To guarantee the mechanical stability of the coil device, the coil winding 25 can be fixed either during or after the winding of the coil with an adhesive or a casting compound. The fixing can be undertaken before or after the external contacts 17 and 21 are established. With gluing or casting before the contacts are established only the freely accessible contact surfaces for the contact 17 and 21 have to be kept free of adhesive or casting medium.

FIG. 4 shows a highly schematic view of a coil winding 35 according to a second exemplary embodiment of the invention. In the coil winding 35 a stack 37 consisting of two layers of strip conductors is wound to the coil. Once again only two turns $W_1$, $W_2$ are shown by way of example, which are intended to stand for a larger number of windings. Likewise the two layers within the stack are also representative of a larger number of layers, for example 3 to 10 layers. Each of the layers comprises a first strip conductor 41, 42 and a second strip conductor 43, 44, which are connected to one another within each layer by way of a third contact 38, 39.

The third contact is once again realized as a soldered connection on the contact sides 13 of the respective strip conductors 41 to 44. The connection is thus made between the contact layers 8 of the strip conductors. The connection of the first 41, 42 and second 43, 44 strip conductors within each layer via the third contacts 38, 39 achieves the result that both on the inside and also on the outside of the coil winding the contact sides 13 are freely accessible for all strip conductors from both layers. Thus the first contact 17 with the first contact pieces 19 and the second contacts 19 with the second contact pieces 23 can be made in a similar way to the first exemplary embodiment without inserting contact pieces into the winding.

In the second exemplary embodiment the strip conductors each have a substrate 2, a buffer layer 4, a superconducting layer 6, a contact layer 8 and a cover layer 10, similar to the layout shown in FIG. 1. When a stack of strip conductors is used, the individual strip conductors however expediently have no separate insulation layer 12. Instead, to insulate the windings from one another, during the manufacturing of the coil, a separate insulator strip (not shown here) is inserted into the winding.

The invention claimed is:

1. A superconducting coil device, comprising:

at least one coil winding, which comprises a first stack formed by at least two first superconducting strip conductors, and a second stack formed by at least two second superconducting strip conductors, said first and second strip conductors each having a superconducting layer and a contact side provided with a contact layer;

at least two first contacts each individually electrically connecting the contact side of a first one of the first strip conductors and a second one of the first strip conductors respectively to an external circuit via respective first contact pieces;

at least two second contacts each individually electrically connecting the contact side of a first one of the second strip conductors and a second one of the second strjp conductors respectively to the external circuit via respective second contact pieces; and at least two third contacts located adjacent one another, each individually electrically connecting the corresponding individual first strip conductor respectively with the corresponding individual second strip conductor via the contact layers of the first and the second strip conductors within the coil winding, wherein the contact side of the first strip conductors has a different orientation relative to a center of the coil winding than the contact side of second strip conductors.

2. The coil device of claim 1, wherein the first and second strip conductors each have turns, wherein the at least two first contacts are disposed on a side of the first strip conductors facing away from the turns of the first strip conductors, and wherein the at least two second contacts are disposed on a side of the second strip conductors facing away from the turns of the second strip conductors.

3. The coil device of claim 1, wherein the at least two first contacts are formed between respective first contact pieces and the contact layer on the contact side of the first strip conductors and the at least two second contacts are formed between respective second contact pieces and the contact layer on the contact side of the second strip conductors.

4. The coil device of claim 1, wherein the at least two first contacts are disposed on an inner side of the coil winding and the at least two second contacts are disposed on an outer side of the coil winding.

5. The coil device of claim 1, wherein the at least two third contacts are formed between the first strip conductors and the second strip conductors via a soldered connection.

6. The coil device of claim 1, wherein a contact resistance of the at least two third contacts is less than 1 μOhm.

7. The coil device of claim 1, wherein a contact resistance of the at least two third contacts is less than 100 nOhm.

8. The coil device of claim 1, wherein the at least two third contacts are formed between the first and the second strip conductors over a length of from 1 cm to 5 cm.

9. The coil device of claim 1, further comprising a cooling device for cooling the windings, wherein in an area of the at least two third contacts, a thermal coupling to the cooling device is more pronounced than in remaining areas of the winding.

10. The coil device of claim 1, wherein the first and second strip conductors each include a superconducting layer containing a second-generation high-temperature superconductor, especially $ReBa_2Cu_3Ox$.

11. The coil device of claim 1, wherein the contact layer and/or the at least two first and second contact pieces contain copper.

12. The coil device of claim 1, wherein the first and the second strip conductors each include a substrate, and another contact layer provided on a side of the substrate that faces away from the superconducting layer and/or are enveloped on all sides by a contact layer.

13. The coil device of claim 1, wherein the coil winding is constructed as a disk winding.

14. The coil device of claim 13, wherein the coil winding is constructed as one of a race-track coil, as a rectangular coil and a cylindrical disk winding.

15. The coil device of claim 1, wherein the turns are mechanically fixed with a casting compound and/or with an adhesive.

16. The coil device of claim 1, comprising an even number of the first and second strip conductors, said first and second strip conductors being connected to one another via an odd number of multiple said third contact.

* * * * *